US005706033A

United States Patent [19]

Kashima

[11] Patent Number: 5,706,033

[45] Date of Patent: Jan. 6, 1998

[54] DISPLAY DATA READOUT CIRCUIT

[75] Inventor: Masahiko Kashima, Tokyo, Japan

[73] Assignee: Kabushiki Kaisha Toshiba, Kawasaki, Japan

[21] Appl. No.: 338,182

[22] Filed: Nov. 9, 1994

[30] Foreign Application Priority Data

Nov. 9, 1993 [JP] Japan ..... 5-279599

[51] Int. Cl.[6] ..... G09G 5/00

[52] U.S. Cl. ..... 345/200; 345/185; 395/507

[58] Field of Search ..... 345/185, 200, 345/10, 28, 189, 190, 139; 395/775, 501, 507, 509; 364/200, 239

[56] References Cited

U.S. PATENT DOCUMENTS

| | | | |
|---|---|---|---|
| 4,332,008 | 5/1982 | Shima et al. | 364/239 |
| 4,342,095 | 7/1982 | Goodman | 345/194 |
| 4,462,084 | 7/1984 | Greenwood | 364/927.8 |
| 4,604,615 | 8/1986 | Funahashi | 345/185 |
| 4,628,467 | 12/1986 | Nishi et al. | 345/200 |
| 4,660,156 | 4/1987 | Guttag et al. | 345/200 |
| 5,343,395 | 8/1994 | Watts | 345/139 |

FOREIGN PATENT DOCUMENTS

| | | | |
|---|---|---|---|
| 0194092 | 9/1986 | European Pat. Off. | 345/185 |
| 0293200 | 11/1988 | European Pat. Off. | 345/185 |
| 1172893 | 7/1989 | Japan | 345/185 |

*Primary Examiner*—Richard Hjerpe
*Assistant Examiner*—Lun-Yi Lao
*Attorney, Agent, or Firm*—Oblon, Spivak, McClelland, Maier & Neustadt, P.C.

[57] ABSTRACT

The display data read out circuit of this invention includes a CPU, data and address buses, a display data address circuit, and an address switching circuit. In a case where a refresh signal from the CPU is in an enable state, the address switching circuit outputs a display data address, obtained from the display data address circuit, into an external memory through the address bus. On the other hand, when the refresh signal is not in the enable state, the address switching circuit outputs an address from the CPU into the external memory through the address bus. Thus, the circuit of this invention transfers display data into the external display using the refresh period of the CPU. This improves the throughput of this CPU.

6 Claims, 10 Drawing Sheets

BUS RELEASE REQUEST (1c)

CORE CPU (1a)

DMA (1b)

SYSTEM CLOCK

280 EFFECTIVE ADDRESS
PC
REFRESH ADDRESS
PC+1

RFSH SIGNAL

M1 SIGNAL

EXTERNAL ADDRESS BUS
PC
DISPLAY DATA ADDRESS
PC+1

CHIP ENABLE SIGNAL

DATA BUS
INSTRUCTION DATA
DISPLAY DATA
INSTRUCTION DATA

DISPLAY DATA TRANSFER SIGNAL

SYSTEM CLOCK CLK
M1 SIGNAL
RFSH SIGNAL
CHIP INABLE SIGNAL 1j
LSB SIGNAL
MSB SIGNAL
DISPLAY DATA TRANSFER SIGNAL 6

DISPLAY DATA READOUT CIRCUIT

BACKGROUND OF THE INVENTION

1. Field of the Invention

This invention relates to a circuit for reading out display data from a memory, and in particular, it relates to a circuit in which a microprocessor unit is used for reading out display data.

2. Description of the Prior Art

Z80 of Zirog Co. is a typical 8 bit microprocessor which is widely used as a microprocessor for home appliances. There are two conventional methods using a microprocessor to transfer display data stored in a memory into a display, such as a liquid crystal display.

In the first method, as shown in FIG. 1, a subroutine call for the transmission of display data is provided in a program routine, which is executed by a microprocessor unit (referred to as MPU, below) 1, and readings and writings of display data are repeated within the subroutine. In actuality, memory 2 forwards data to bus 4 once it receives from MPU 1 a data transfer request signal 5. On the other hand, display 3 accepts the data on bus 4 by responding to data accept request signal 6 from MPU 1. These steps are repeated by required times 'k' so as to complete the transmission of display data. This procedure is illustrated in the flowchart shown in FIG. 2.

In the second method, as shown in FIG. 3, a direct memory access circuit (referred to as DMA, below) 1*b* is provided inside MPU 1 in addition to a core CPU 1*a*. Display data is transferred from memory 2 to display 3 via DMA 1*b* at a high speed. In actuality, DMA 1*b* outputs bus release request signal 1*c* to core CPU 1*a*. Then, core CPU 1*a* interrupts its operation and releases bus 4 for DMA 1*b*, which will then transfer display data directly from memory 2 to display 3. The operating procedure is shown in FIG. 4.

In the above first method, however, a routine for reading out display data has to be prepared in advance as a part of the main program. As a result, the number of steps contained in the main program increases, resulting in the increase of time and labor for the program development. It is rather a serious problem that MPU 1 can't handle any other processes unless it has completed the display data read out routine. Recently, the size of display data has greatly increased as a display screen has become large in size. Therefore, the running time required by the display data read out routine occupies a large ratio in the whole running time, thus lowering the process rate of the whole program.

On the other hand, in the above second method, DMA 1*b* keeps outputting a bus release request signal to core CPU 1*a*, as long as the display data read out routine is being executed. During this period, the internal address and data buses of MPU 1 are available only for DMA 1*b*. As a result, core CPU 1*a* can't handle any other tasks in which handling of bus 4 is required.

SUMMARY OF THE INVENTION

This invention has been made to overcome the above mentioned problems of the prior art.

Therefore, the objective of the present invention is to provide a display data read out circuit which can satisfy the following conditions:

1) a main program does not need a special inside routine for reading out display data;
2) display data can be transferred from a memory to a display even if an MPU is executing other tasks using buses; and 3) a bus release request signal is not required to be sent to a core CPU.

In order to accomplish the above mentioned objectives, the display data read out circuit of this invention has a CPU, data and address buses, a display data address circuit for storing display data addresses, and an address switching circuit connected with the CPU and the display data address circuit. The address switching circuit outputs a display data address from the display data address circuit into an external memory through the address bus when a refresh signal from the CPU is in an enable state. On the other hand, the address switching circuit outputs an address from the CPU into the external memory through the address bus when the refresh signal from the CPU is not in the enable state.

In today's electronic industry, especially for business appliances, enormous advancement has been made to reduce the consumption of electricity. As a result, in such appliances, a dynamic RAM (DRAM) is rarely used as a memory, while a static RAM (SRAM) is widely used.

Due to the above reason, the refresh signal in an 8 bit CPU, such as a Z80 CPU, does not function any more. The bus period for the refresh signal to occupy has come into a completely useless period. This invention uses this bus period for transmitting display data.

Thus, the display data readout circuit of this invention transmits display data into an external display during the refresh period. As a result, the CPU, such as a Z80 CPU, can operate without being interrupted.

These and other objectives, features, and advantages of the present invention will be more apparent from the following detailed description of preferred embodiments in conjunction with the accompanying drawings.

DETAILED DESCRIPTION OF PREFERRED EMBODIMENTS

Figure 1:
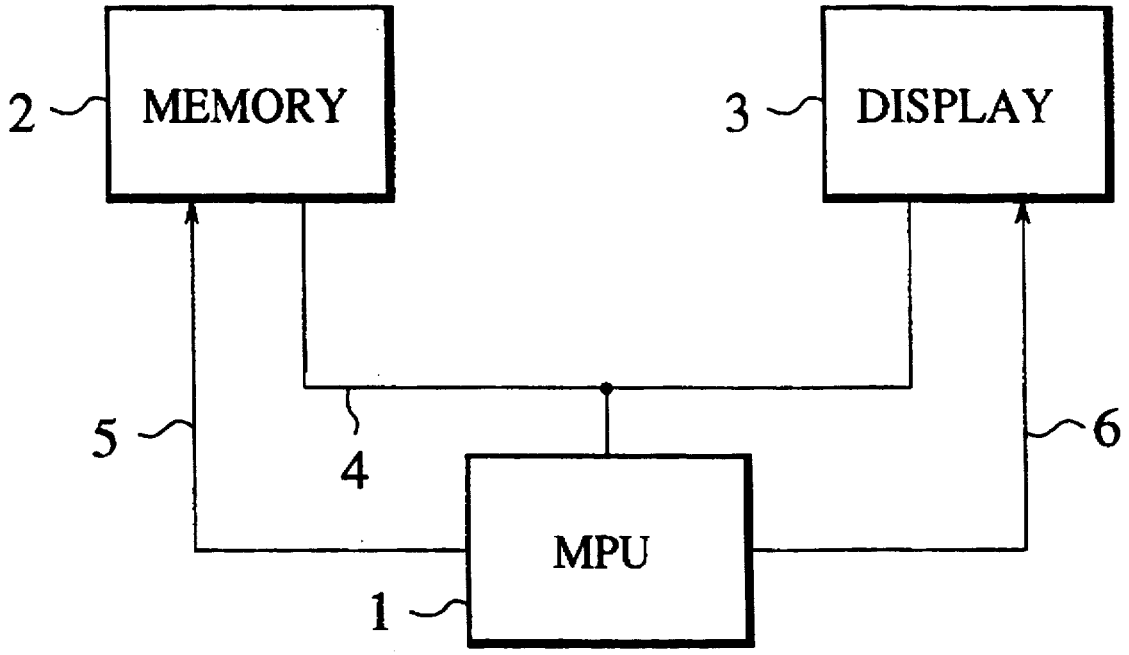
FIG. 1 PRIOR ART
FIG. 1 is a block diagram showing a prior art system for reading out display data.
Figure 2:
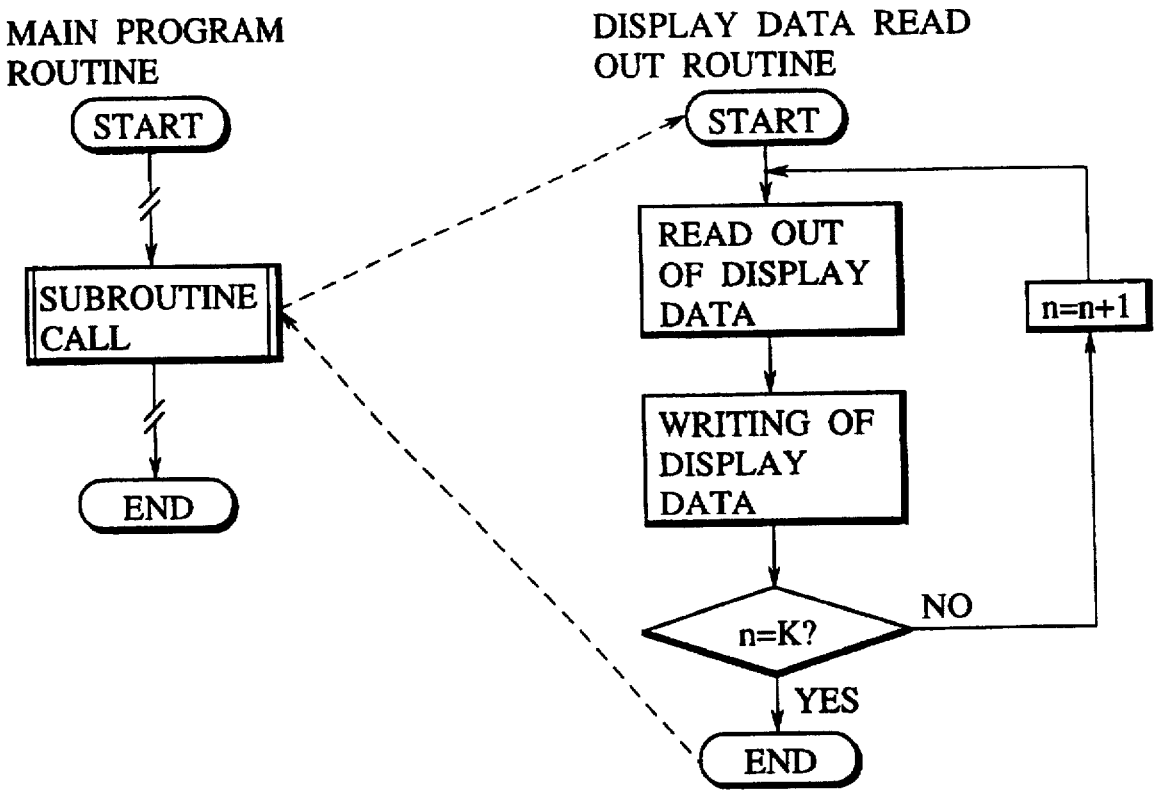
FIG. 2 PRIOR ART
FIG. 2 is a flow chart for explaining the display data read out process using the system shown in FIG. 1.
Figure 3:
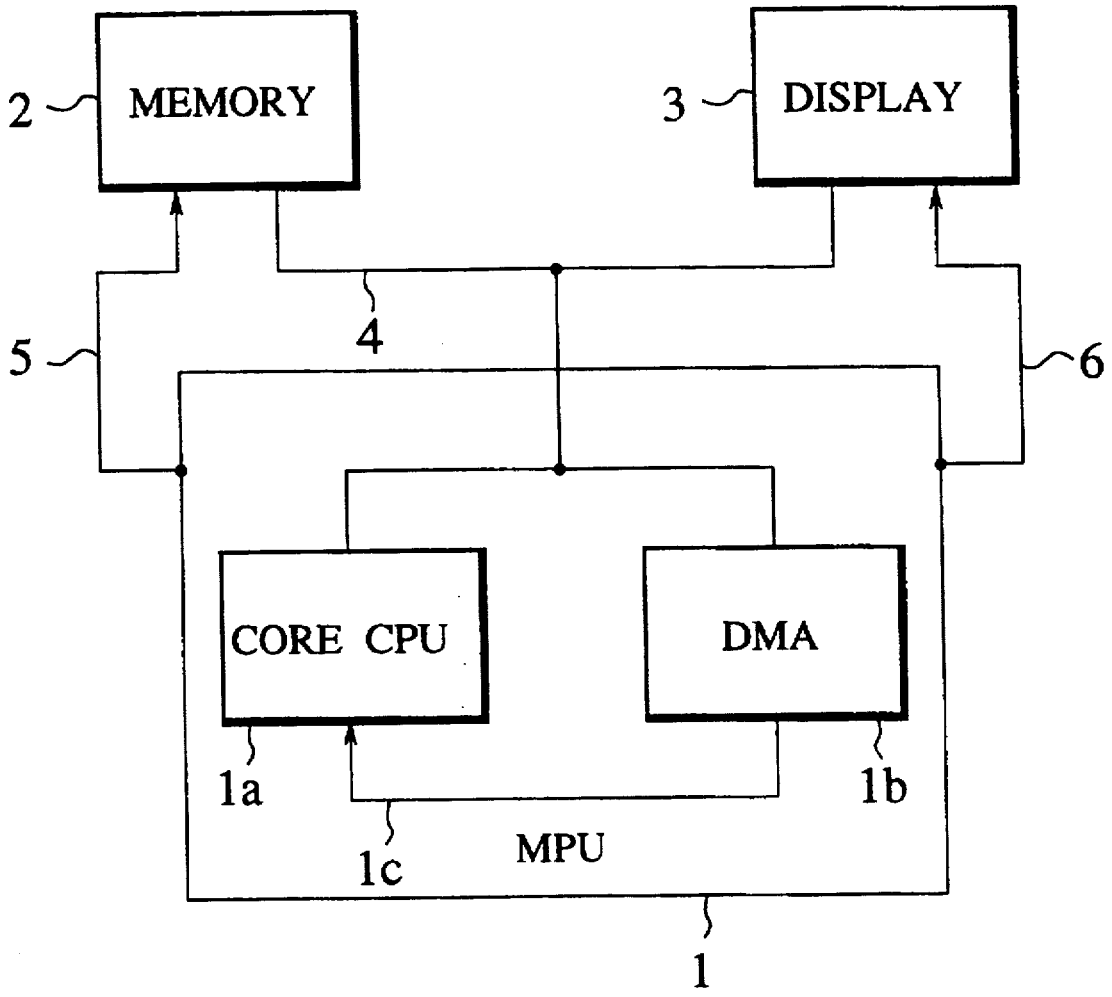
FIG. 3 PRIOR ART
FIG. 3 is a block diagram showing another prior art system for reading out display data.
Figures 4A, 4B, 4C:
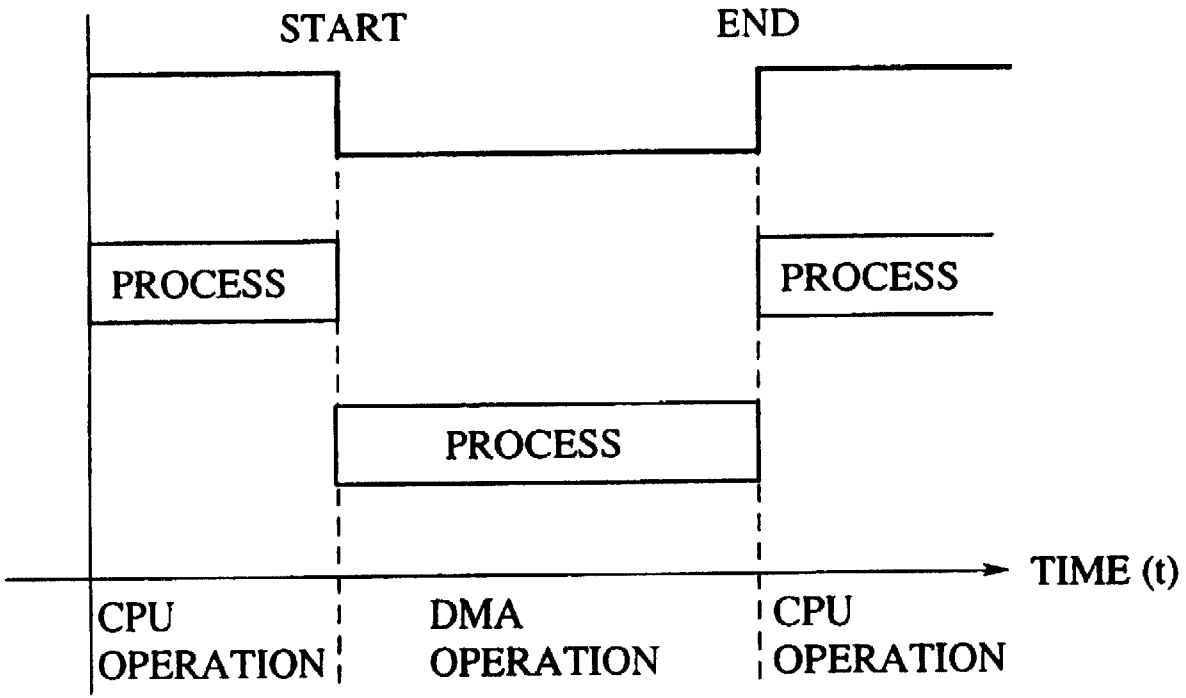
FIG. 4 is a timing chart for explaining the display data read out process using the system shown in FIG. 3.
Figure 5:
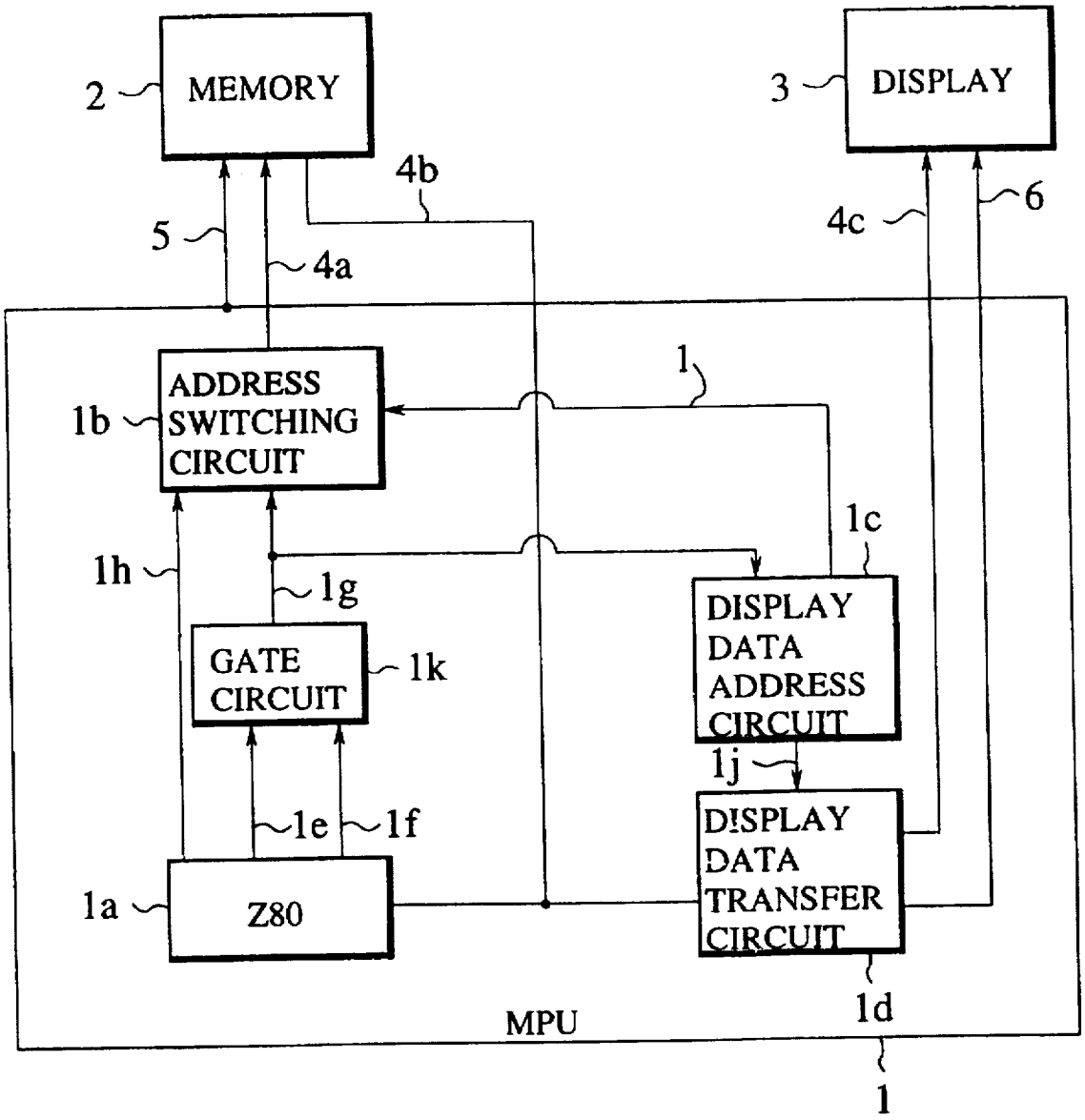
FIG. 5 is a block diagram showing the structure of a display data read out circuit according to one embodiment of the present invention.

FIG. 5 shows a data processing system in which a display data read out circuit according to one preferred embodiment of this invention is included.

As shown in FIG. 5, the data processing system is comprised of a memory 2 which stores display data and other data, an MPU 1 which executes data processings using memory 2, and a display 3 which displays the data processed by MPU 1. The main part of MPU 1 is comprised of an 8 bit CPU 1*a*, such as a Z80 CPU, which executes data operation and data transfer, and a display data transfer circuit 1*d*, which can transfer display data from memory 2 to display 3 by itself without being helped by CPU 1*a*. In this embodiment, a static RAM (SRAM) is used as memory 2. In many computers, a DRAM is widely used as the main memory. However, an SRAM is widely used in many electronic apparatus for office appliances, such as electronic notebooks and electronic dictionaries. This is because an SRAM is advantageous for reducing electric consumption as well as for holding data.

In addition to the above structure, MPU 1 further includes a display data address circuit 1*c*, a gate circuit 1*k*, which is an AND gate, and an address switching circuit 1*b*. The operation of these circuits will be explained later in detail together with the whole operation of this system.

Figure 6:
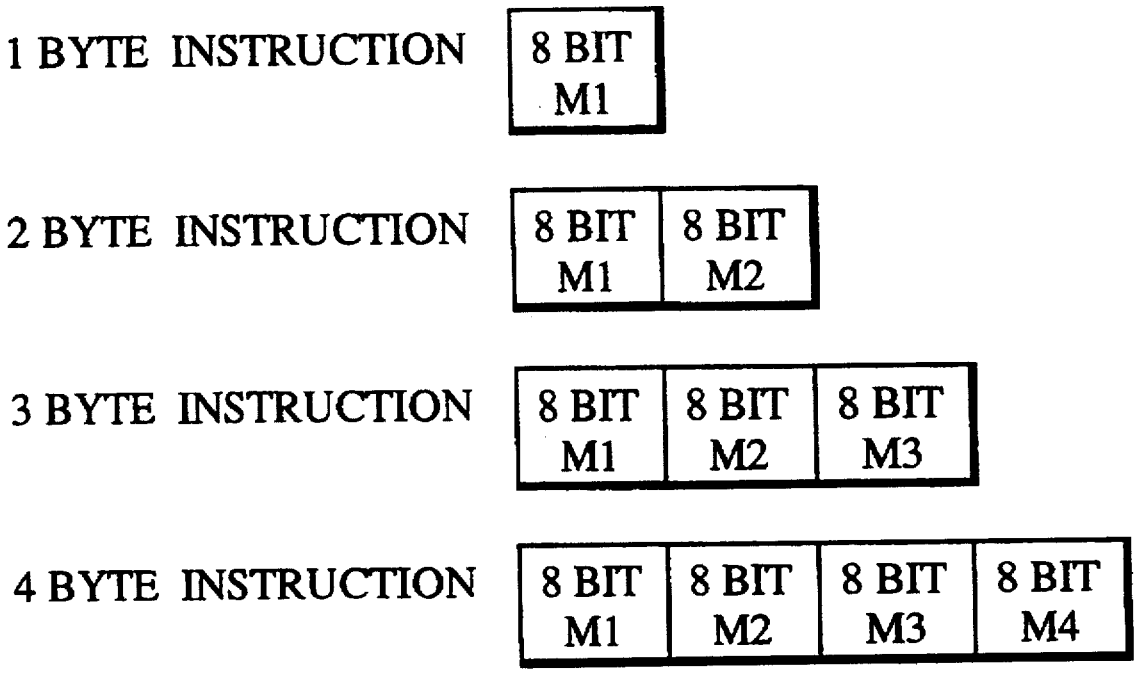
FIG. 6 is a view for explaining instructions produced by a Z80 CPU.

As shown in FIG. 6, there are four kind of instructions that are executed by Z80 CPU 1*a*. Each front byte of the instructions is called an M1 cycle in which an operation code is stored for indicating to the Z80 CPU 1*a* what to do next. In this M1 cycle, an M1 signal always keeps an enable state in order to indicate that the data are not simple data but an instruction. The M1 cycle is comprised of four clocks. An instruction fetch and the analysis of this instruction are conducted in the first two clocks.

In the succeeding two clocks, Z80 CPU 1*a* outputs a refresh address and a refresh signal, which are utilized to execute a refresh operation for memory holding when a DRAM is connected as the external memory. As far as Z80 CPU 1*a* outputs the refresh signal, the M1 signal is in an activated state. Therefore, both enable signals of these signals do not overlap.

Figures 7A, 7B, 7C, 7D, 7E, 7F, 7G, 7H:
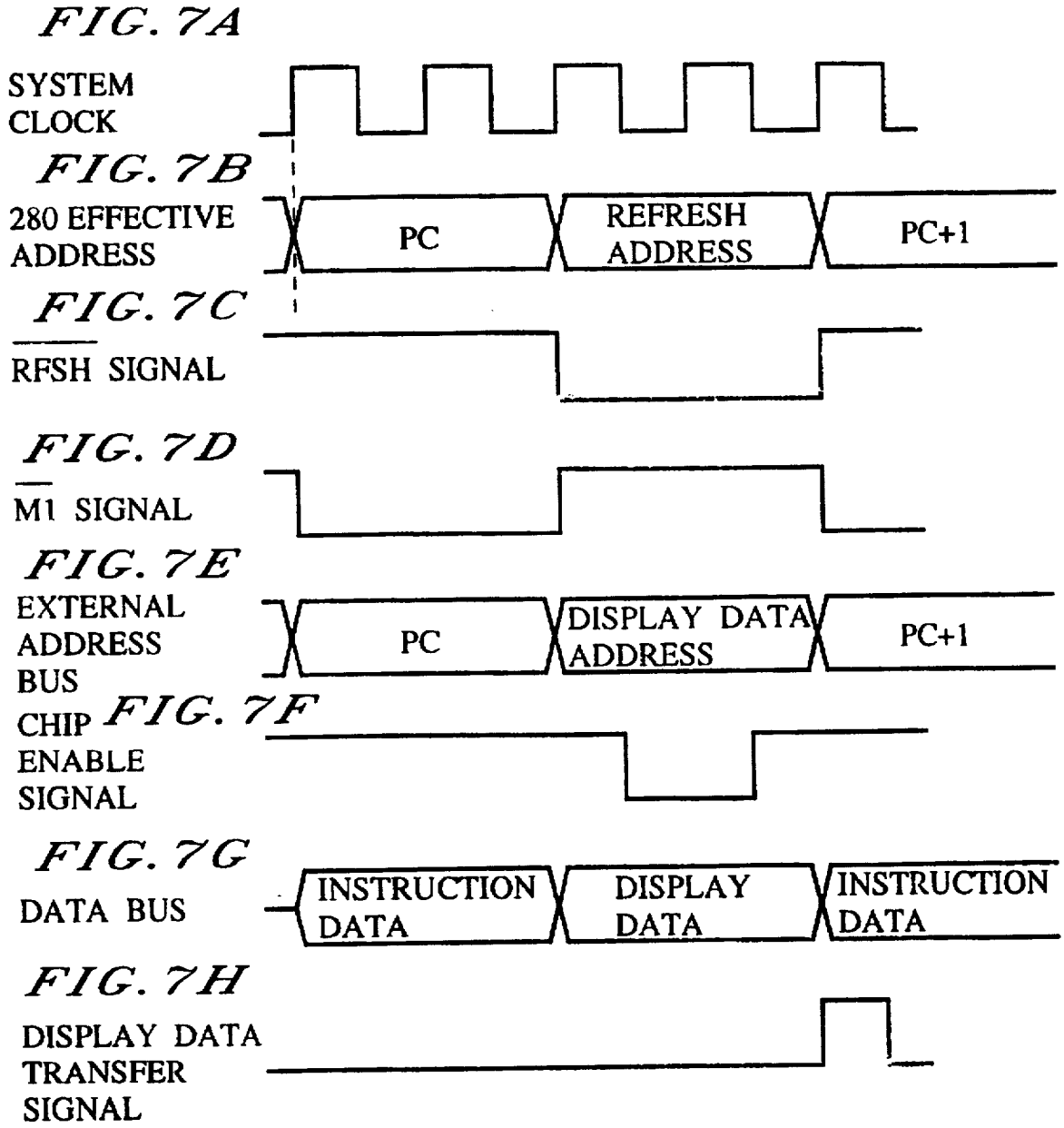
FIG. 7 is a timing chart for explaining the operation of the display data read out circuit shown in FIG. 5.

Next, the process for a display data transfer will be explained below with referring to FIGS. 5 and 7.

In the first two clocks of M1 cycle, an inverted M1 signal is output to signal line 1*f*, and an effective address, which is indicated by a program counter in Z80 CPU 1*a*, is output to an address bus.

During this period, inverted line 1*e* of refresh signal RFSH and output line 1*g* of gate circuit 1*k* are kept at low levels. Address switching circuit 1*b* receives addresses from Z80 CPU 1*a* and display data address circuit 1*c* respectively through signal lines 1*h* and 1*in*. This circuit 1*b* outputs an address from Z80 CPU 1*a* to external address bus 4*a* when gate switching signal 1*g* is at a low level, while it outputs an address from display data address circuit 1*c* to external address bus 4*a* when gate switching signal 1*g* is at a high level. Then, memory 2 outputs instruction data to data bus 4*b* according to the address from Z80 CPU 1*a* when data transfer request signal 5 comes into an enable state.

In the latter two clocks, the refresh signal and M1 signal turn round respectively, allowing gate switching signal 1*g* from gate circuit 1*k* to become a high level. As a result, address switching circuit 1*b* outputs a display data address, which is obtained from display data address circuit 1*c*. Display data are, thus, output on data bus 4*b*. In this moment, display data address circuit 1*c* outputs a chip enable signal 1*j* into display data transfer circuit 1*d* in synchronous with gate switching signal 1*g*. According to chip enable signal 1*j*, display data transfer circuit 1*d* stores in display data which correspond to the data on data bus 4*b*. At the same time, display data address circuit 1*c* increments the display data address.

At this point, Z80 CPU 1*a* turns to the next operation cycle in which the refresh signal and M1 signal turn around. Then, the instruction to be executed next is fetched, and it is processed in the same way as that of mentioned above. In addition, with the start of a new M1 cycle, display data transfer circuit 1*d* transfers display data, which correspond to the data on data bus 4*b*, into display 3. In this case, display data bus 4*c* for transferring display data into display 3 is different from data bus 4*b* connected with memory 2. Therefore, these data do not come into collision with each other.

In summary, according to the present invention, display data are transferred into display 3 using a refresh period of a CPU. A result, the executing speed of the Z80 CPU is substantially improved.

Figure 8:
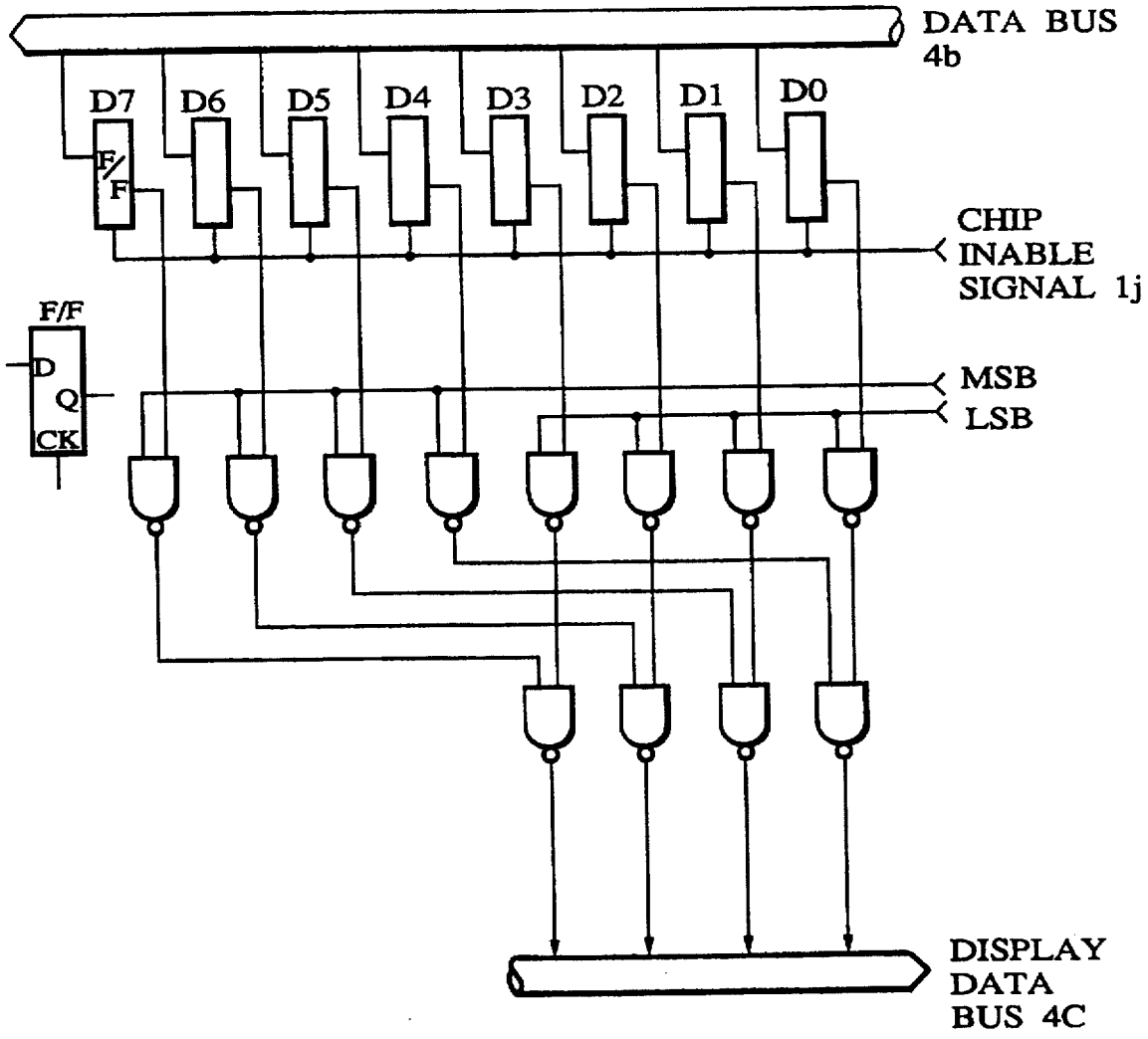
FIGS. 8 and 9 are a diagram showing a display data transfer circuit shown in FIG. 5.
Figure 9:
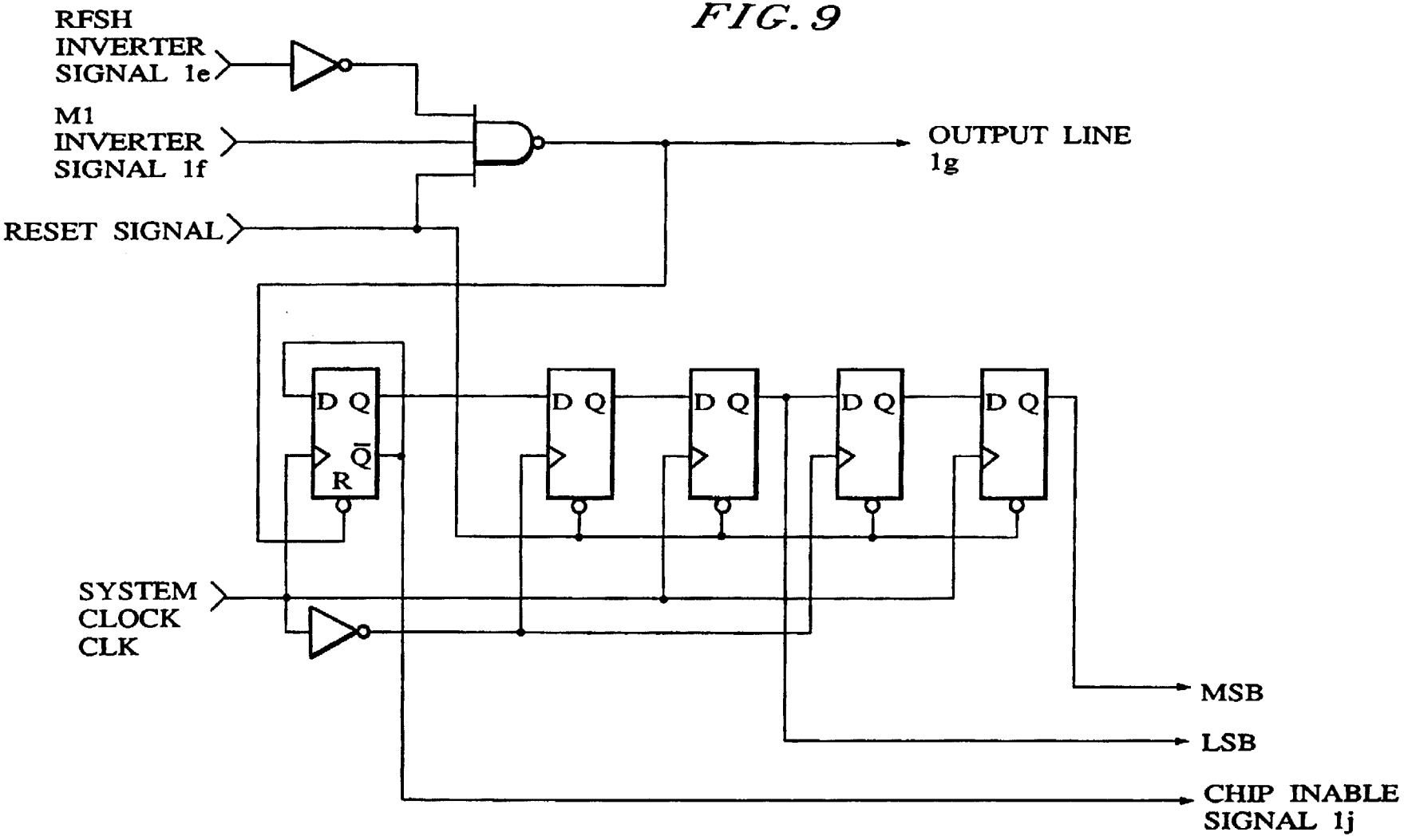
Figures 10A, 10B, 10C, 10D, 10E, 10F, 10G:
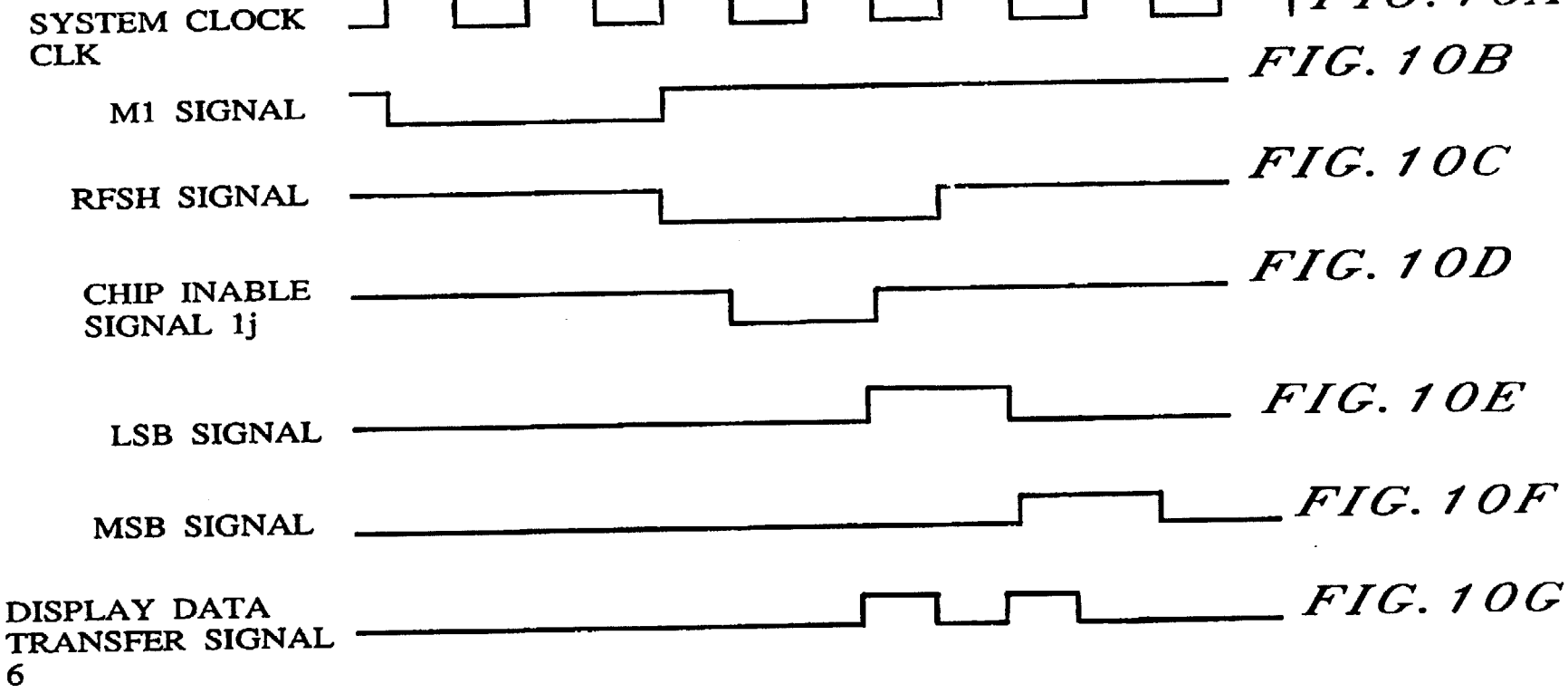
FIG. 10 is a timing chart for explaining an operation of the display data transfer circuit shown in FIGS. 8 and 9.

Furthermore, referring to FIGS. 8, 9, and 10, there is shown a detailed construction of the display data transfer circuit 1*d* shown in FIG. 5.

FIGS. 8 and 9 are a diagram showing a display data transfer circuit shown in FIG. 5; and FIG. 10 is a timing chart for explaining an operation of the display data transfer circuit shown in FIGS. 8 and 9.

What is claimed is:

1. A display data read out circuit for reading out display data from an external memory composed of an SRAM, comprising:

a CPU designed for fetching and decoding an instruction in a M1 cycle including a first half period and a second half period, the second half period of said M1 cycle being allotted to a refresh cycle;

data and address buses for exchanging data between said CPU and said external memory;

a display data address circuit for generating display data addresses; and an address switching circuit connected with said display data address circuit and said CPU, said address switching circuit outputting a display data address from said display data address circuit into said external memory via an address bus when a refresh signal from said CPU is in an enable state during the second half period of said M1 cycle, and said address switching circuit outputting an address from said CPU into said external memory via said address bus when said refresh signal from said CPU is not in said enable state.

2. The display data read out circuit as claimed in claim 1, wherein said CPU executes a refresh operation automatically once an instruction has been read out from said memory.

3. The display data read out circuit as claimed in claim 1, wherein a Z80 CPU is used as said CPU.

4. The display data read out circuit as claimed in claim 1, wherein said address switching circuit is connected with said CPU via a gate circuit, which is to detect conditions of said refresh signal.

5. The display data read out circuit as claimed in claim 1, wherein said CPU, said data and address buses, said display data address circuit, and said address switching circuit are incorporated in a microprocessor unit.

6. The display data read out circuit as claimed in claim 5, wherein said microprocessor unit further includes a display data transfer circuit for directly transferring display data from said external memory into an external display.

* * * * *